US005927022A

United States Patent [19]

Hirakawa et al.

[11] Patent Number: 5,927,022

[45] Date of Patent: Jul. 27, 1999

[54] MULTIPURPOSE FIELD MOVING METHOD AND APPARATUS

[75] Inventors: Hajime Hirakawa, Kobe; Kazuyuki Akimoto, Matsudo; Shigemi Okada, Tokyo; Sadaaki Murakawa, Kobe; Shinichi Sugiyama, Miki; Taizo Tsutusi, Kobe, all of Japan

[73] Assignee: Kawasaki Jukogyo Kabushiki, Hyogo, Japan

[21] Appl. No.: 08/897,910

[22] Filed: Jul. 21, 1997

[30] Foreign Application Priority Data

Aug. 9, 1996 [JP] Japan ..... 8-227432

[51] Int. Cl.[6] ..... E04B 3/10

[52] U.S. Cl. ..... 52/6; 52/7; 52/741.1; 472/92

[58] Field of Search ..... 52/6, 7, 64, 741.1; 472/85, 92, 94; 414/676

[56] References Cited

U.S. PATENT DOCUMENTS

| | | | |
|---|---|---|---|
| 2,421,274 | 5/1947 | Levey | 52/64 X |
| 3,820,467 | 6/1974 | Burdick | 414/676 X |
| 4,355,940 | 10/1982 | Derickson | 414/676 X |
| 4,567,957 | 2/1986 | Johnson | 414/676 X |
| 5,187,894 | 2/1993 | Ripley, Sr. et al. | 52/6 X |
| 5,682,711 | 11/1997 | Warczak | 52/6 |
| 5,746,028 | 5/1998 | DiBenedetto | 52/6 |

FOREIGN PATENT DOCUMENTS

| | | | |
|---|---|---|---|
| 169434 | 11/1951 | Austria | 52/6 |
| 2704261 | 10/1994 | France | 52/6 |
| 4-327868 | 11/1992 | Japan . | |

*Primary Examiner*—Carl D. Friedman
*Assistant Examiner*—Timothy B. Kang
*Attorney, Agent, or Firm*—Marshall, O'Toole, Gerstein, Murray & Borun

[57] ABSTRACT

Provided are a method for moving a multipurpose field and an apparatus for the same wherein the multipurpose field can be caused to float above a basic floor plate under a fluid pressure and can be moved and placed in a desired position by delivery means. The moving apparatus comprises a nozzle provided over a basic floor plate common to a field region of a roofed stadium and an outdoor region for detecting existence of the multipurpose field and for jetting a fluid upward in response to a detection signal, and delivery means for alternately moving the multipurpose field between both the regions.

8 Claims, 19 Drawing Sheets

Fig. 9
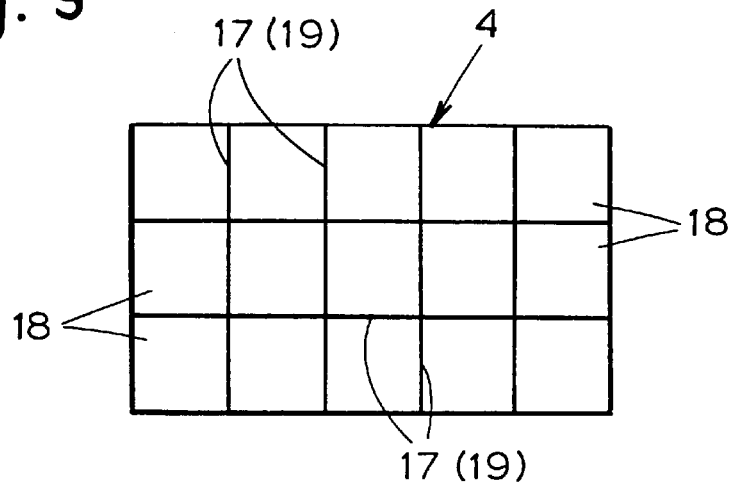
Fig. 10
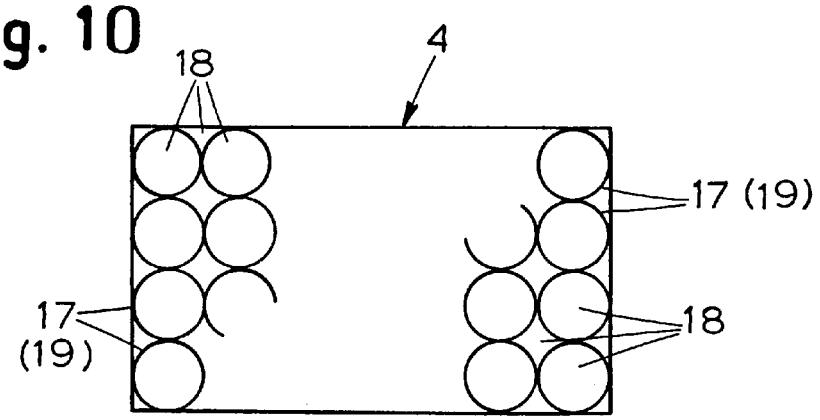
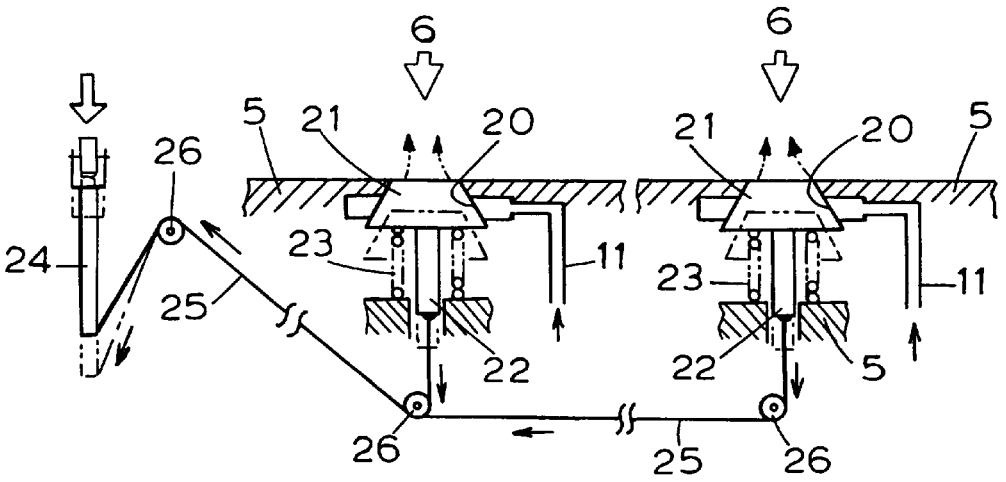
Fig. 11

Fig. 12
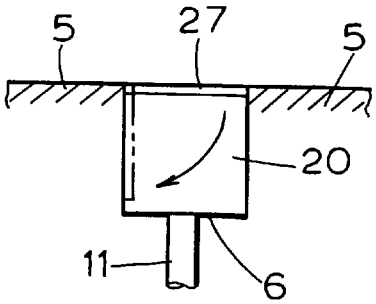
Fig. 13
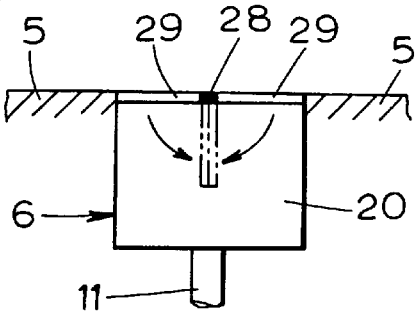
Fig. 14A
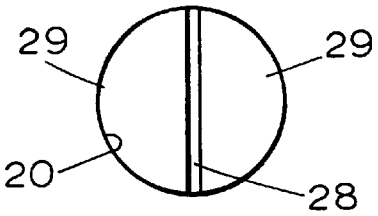
Fig. 14B
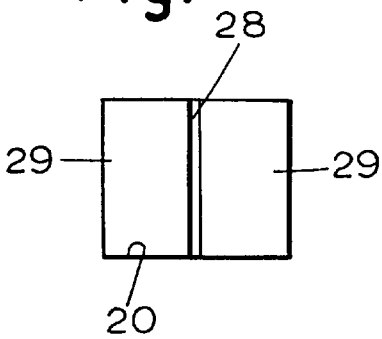
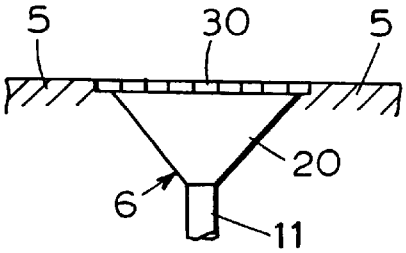
Fig. 15

Fig. 16A
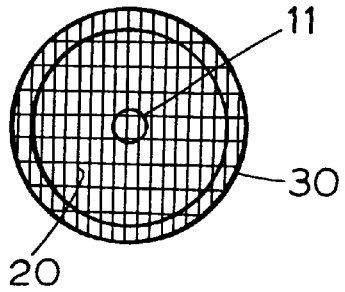
Fig. 16B
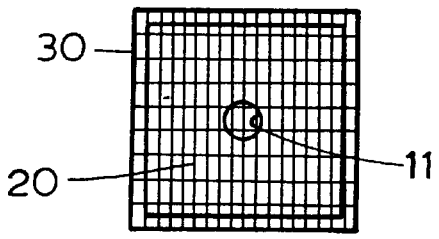
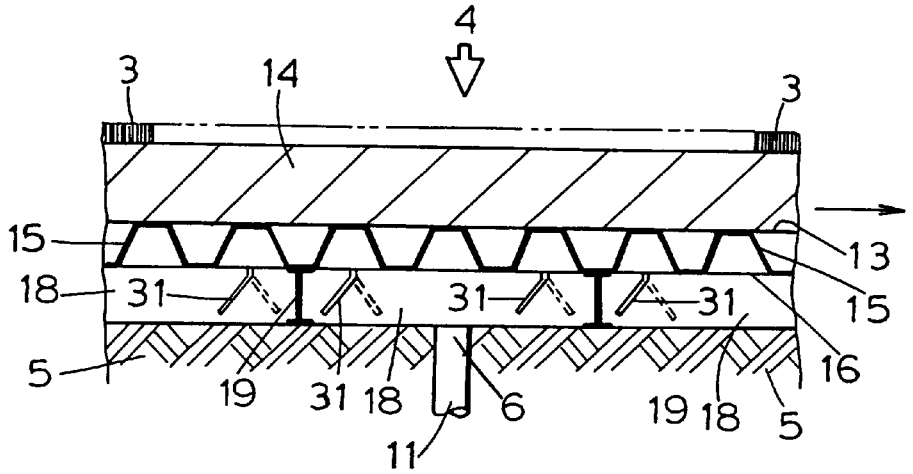
Fig. 17
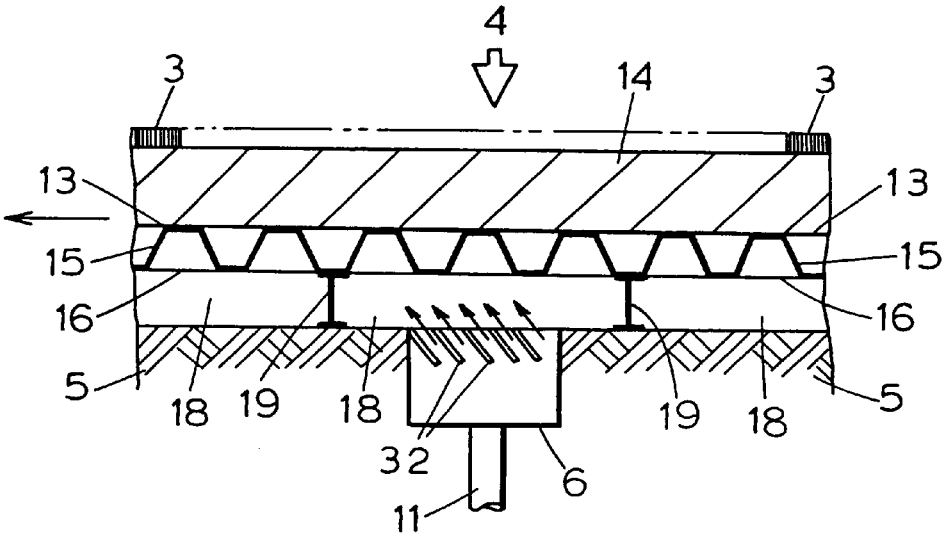
Fig. 18

Fig. 21
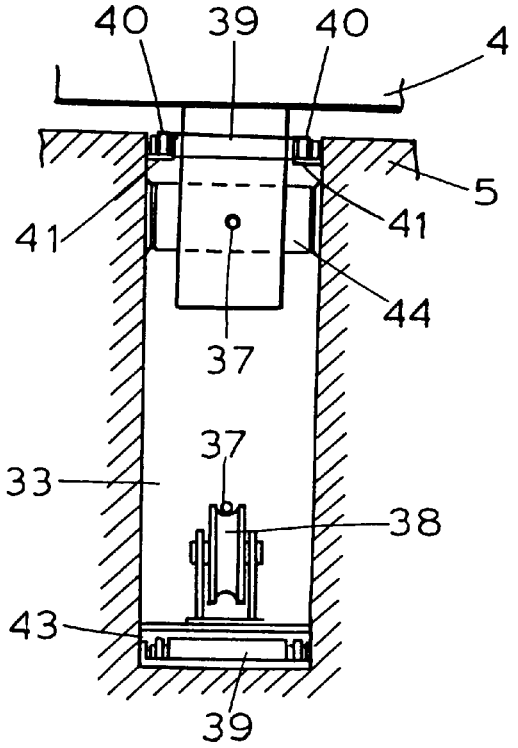
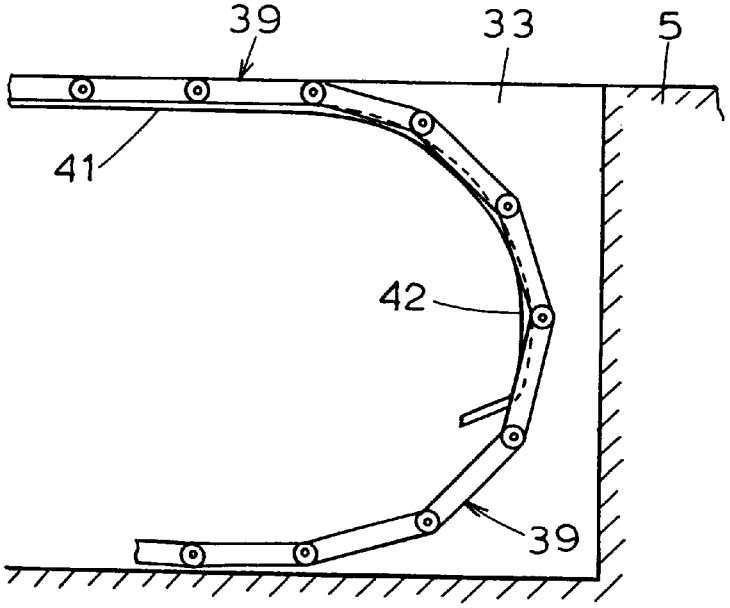
Fig. 22

MULTIPURPOSE FIELD MOVING METHOD AND APPARATUS

FIELD OF THE INVENTION

The present invention relates to a method for moving a multipurpose field by using a pressure fluid and an apparatus for the same.

BACKGROUND OF THE RELATED ART

A stadium field system has been proposed in which a game field using a good natural lawn can be utilized to play soccer and rugby or play other games freely in a roofed stadium. More specifically, a game field having a natural lawn planted on a frame is movably fitted in a trench provided between a field region of a roofed stadium and an outdoor region for growing the natural lawn, and transporting means for running in the trench is provided on the frame such that the game field is alternately moved to both of the field region of the roofed stadium and the outdoor region (see Japanese Unexamined Patent Publication No.HEI4-327868, for example).

According to the prior art, it has been acknowledged that the game field using a good natural lawn can easily be placed also in the roofed stadium, various games such as soccer and rugby can be played on the natural lawn, and the natural lawn can be grown by placement of the game field in the outdoor region. However, a trench having a pit structure for moving the game field is provided between the field region of the roofed stadium and the outdoor region. Therefore, when using the game field in the outdoor region, the trench for movement is remained in the field region of the roofed stadium. For this reason, when using the field region for baseball games, the trench should be blocked to newly form a diamond field for baseball. Furthermore, since the game field employs the transporting means having a truck structure, its thickness exceeds 1 m. Accordingly, it is predicted that a large amount of materials are required to block the deep trench and a lot of time and labor are necessary for taking in and out the materials. Although such a trench having a pit structure can be used for a pool or a skating rink, it is used, with difficulty, for other games including events for other purposes.

SUMMARY OF THE INVENTION

It is an object of the present invention to provide a method and apparatus for moving a multipurpose field in which the multipurpose field can be caused to float above a basic floor plate under a fluid pressure, and can be moved and provided in a desired position by simple and small delivery means.

A first aspect of the present invention is directed to a method for moving a multipurpose field between a field region of a roofed stadium and an outdoor region, comprising the steps of:

causing the multipurpose field to float under a pressure of a fluid jetted upward from a basic floor plate; and moving and placing the multipurpose field by delivery means.

A second aspect of the present invention is directed to a method for moving a multipurpose field in a field region of a roofed stadium, comprising the steps of:

causing the multipurpose field to float under a pressure of a fluid jetted upward from a basic floor plate, and moving and placing the multipurpose field by delivery means.

A third aspect of the present invention is directed to a method for moving a multipurpose field in an outdoor region, comprising the steps of:

causing the multipurpose field to float under a pressure of a fluid jetted upward from a basic floor plate, and moving and placing the multipurpose field by delivery means.

A fourth aspect of the present invention is directed to an apparatus for moving a multipurpose field comprising:

a nozzle provided over a basic floor plate common to a field region of a roofed stadium and an outdoor region for jetting a fluid upward in response to a detection signal of existence of the multipurpose field; and delivery means for alternately moving the multipurpose field between the both regions.

A fifth aspect of the present invention is directed to an apparatus for moving a multipurpose field comprising:

a nozzle provided over a basic floor plate in a field region of a roofed stadium for jetting a fluid upward in response to a detection signal of existence of the multipurpose field; and delivery means for moving the multipurpose field in the field region.

A sixth aspect of the present invention is directed to an apparatus for moving a multipurpose field comprising:

a nozzle provided over a basic floor plate in an outdoor region for jetting a fluid upward in response to a detection signa of existence of the multipurpose field; and delivery means for moving the multipurpose field in the outdoor region.

A seventh aspect of the present invention is directed to the apparatus for moving a multipurpose field as defined in any of the fourth to sixth aspects, wherein the main of the delivery means is provided on a basic floor plate side.

An eighth aspect of the present invention is directed to the apparatus for moving a multipurpose field as defined in any of the fourth to sixth aspects, further comprising means provided over a lower face of the multipurpose field or on a fluid jetting port of each of all the nozzles for applying a pressure of the fluid jetted in a direction of movement of the multipurpose field.

BRIEF DESCRIPTION OF THE DRAWINGS

FIG. 9 is a rear view showing another example of the arrangement of the flat bar or the beam on the lower face of the multipurpose field in FIG. 7;

FIG. 10 is a rear view showing a further example of the arrangement of the flat bar or the beam on the lower face of the multipurpose field in FIG. 7;

FIG. 11 is a sectional view showing an example of the nozzle;

FIG. 12 is a sectional view showing another example of the nozzle;

FIG. 13 is a sectional view showing yet another example of the nozzle;

FIGS. 14 (*a*) and 14 (*b*) are plan views of FIG. 13;

FIG. 15 is a sectional view of a further example of the nozzle;

FIGS. 16 (*a*) and 16 (*b*) are plan views of FIG. 15;

FIG. 17 is a sectional view showing a main part of an example of delivery means of the multipurpose field;

FIG. 18 is a sectional view showing a main part of another example of the delivery means of the multipurpose field;

FIG. 21 is a longitudinal front view of FIG. 19;

FIG. 22 is a side view showing a main part of a pit cover in FIG. 19;

DETAILED DESCRIPTION OF INVENTION

A preferred embodiment of the present invention will be described in detail with reference to the drawings.

Figure 1:
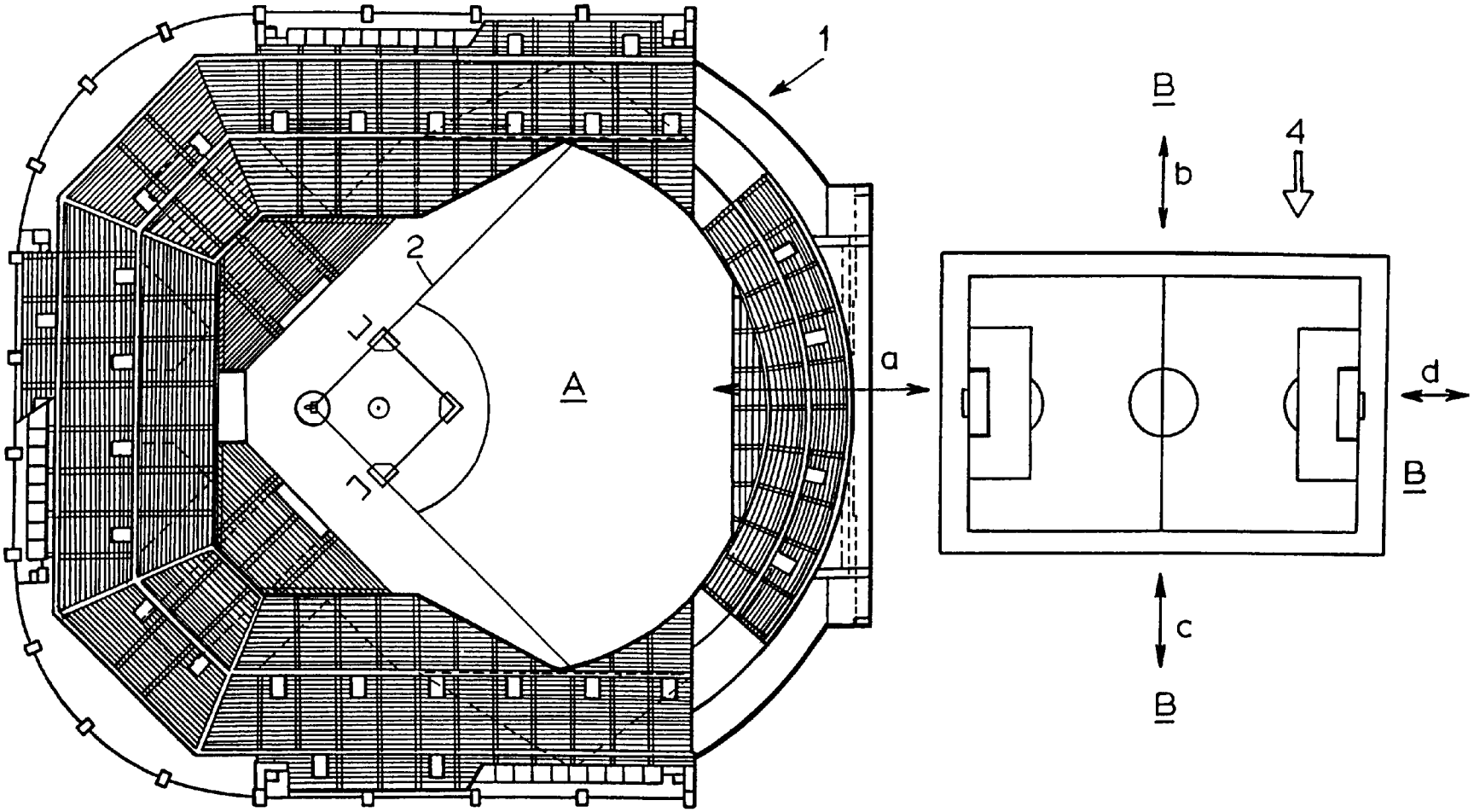
FIG. 1 is a plan view showing, by an arrow, a range of movement of a multipurpose field, in which a roofed stadium and an outdoor region are provided together.
Figure 2:
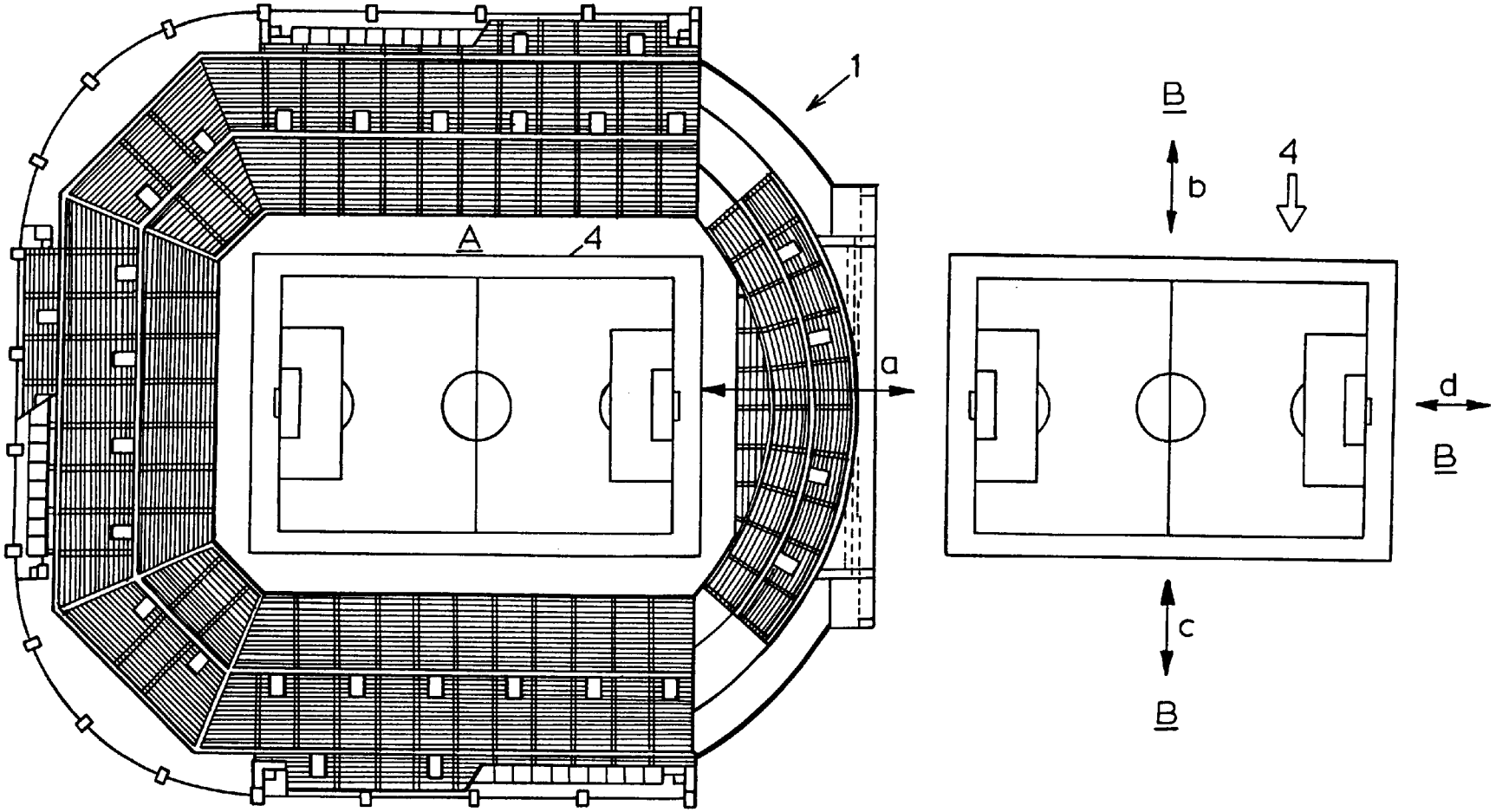
FIG. 2 is a plan view showing, by an arrow, the range of the movement of the multipurpose field, in which the roofed stadium and the outdoor region are provided together.

FIGS. 1 and 2 show examples in which a field region A of a roofed stadium 1 is used as a diamond field 2 for baseball games and a multipurpose field 4 having a natural lawn 3 planted is used for games such as soccer and rugby in an outdoor region B. In the outdoor region B, the multipurpose field 4 grows the natural lawn 3 and is moved and placed in the roofed stadium 1 as shown by an arrow "a" such that the games can be played in all seasons and weathers such as winter, rain and snow and the field region A of the roofed stadium 1 can be used for multipurpose events. In the outdoor region B, furthermore, seats (which are not shown) are provided such that the games can be watched in addition to the growth of the natural lawn 3, and the multipurpose field 4 is moved in a direction of an arrow "b", "c" or "d" such that the outdoor region B can be used for events other than soccer and rugby. Thus, the whole outdoor region B can be used for many purposes.

With reference to FIGS. 3 to 16 (*a*) and 16 (*b*), means for causing the multipurpose field 4 to float for movement will be described below.

Figure 3:
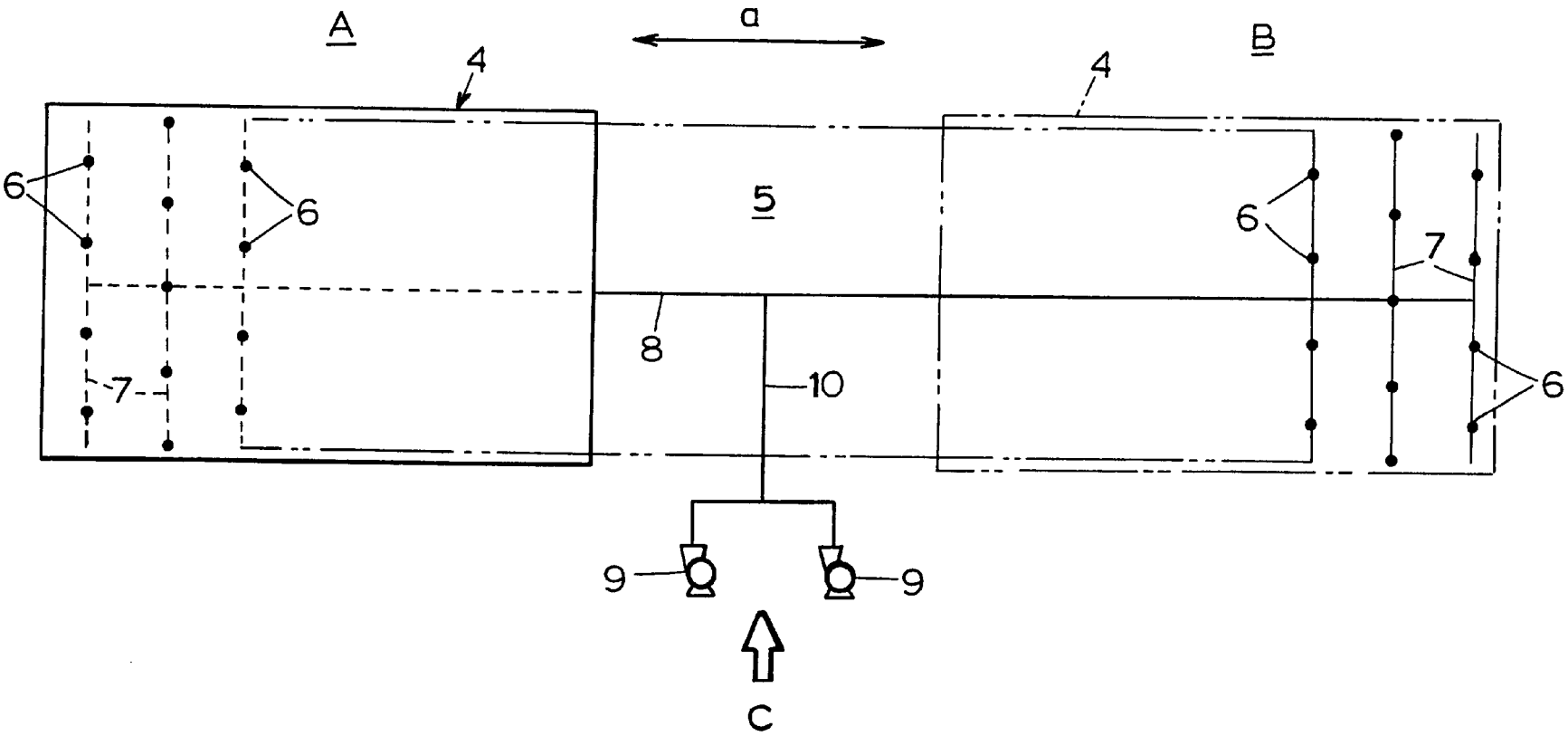
FIG. 3 is a plan view showing arrangement of a nozzle on a basic floor plate in the roofed stadium and the outdoor region.
Figure 4:
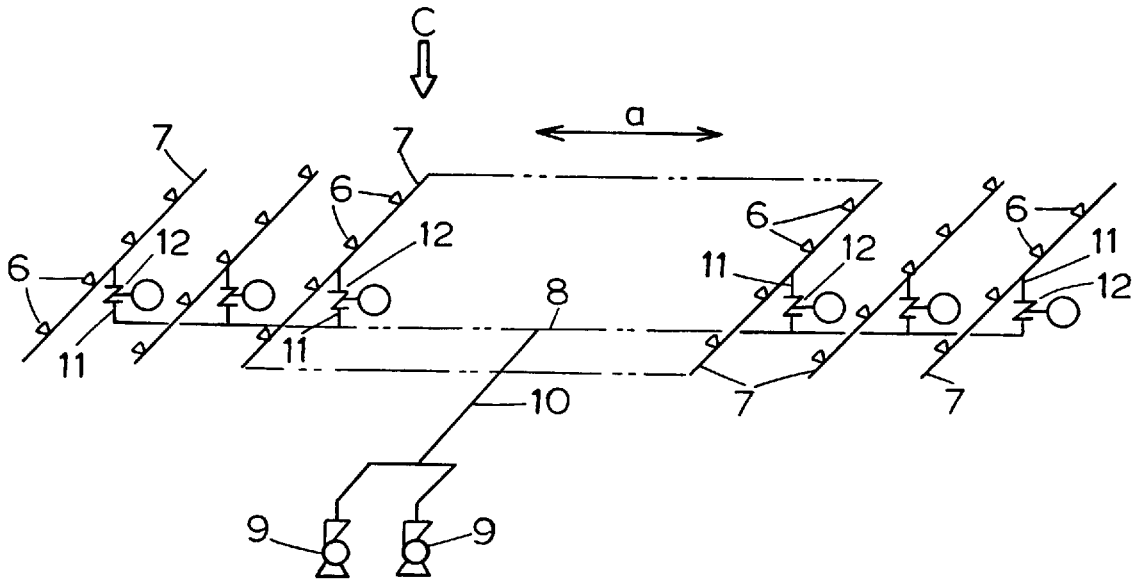
FIG. 4 is a perspective view of FIG. 3.
Figure 5:
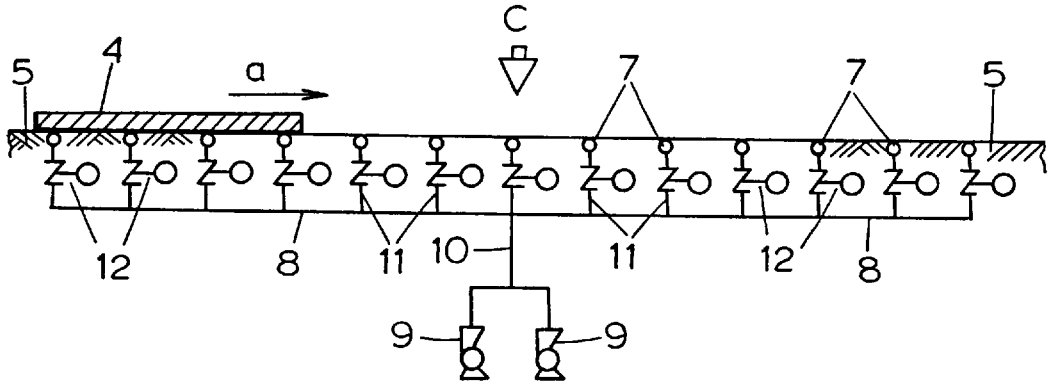
FIG. 5 is a side view of FIG. 3.

FIGS. 3 to 5 show the field region A of the roofed stadium 1, the outdoor region B, and a nozzle equipment C provided on a surface portion of a basic floor plate 5 for upward jetting a pressure fluid such as air, the basic floor plate 5 being formed in a region for connecting the regions A and B. The nozzle equipment C has the following structure. A pipe 7 is provided, at regular intervals, with a lot of nozzles 6 for jetting the pressure fluid upward and is embedded in a surface portion of the whole basic floor plate 5 at regular intervals in a direction orthogonal to the delivery direction "a" of the multipurpose field 4. An air feeding pipe 8 for feeding the pressure fluid such as air is connected to a central portion of the pipe 7. A duct 10 having a plurality of nozzle blowers 9 is connected to one of sides of the air feeding pipe 8.

A motor damper 12 is provided on the duct 11 for connecting the pipe 7 having the nozzle 6 to the air feeding pipe 8 such that a pressure of the fluid jetted from the nozzle 6 is automatically controlled and regulated. A sensor 80 for detecting the multipurpose field 4 is provided in a position close to the pipe 7 having the nozzle 6. The detecting sensor 80 serves to open the motor damper 12 in response to a sensor signal detecting existence of the moving multipurpose field 4 so that the pressure fluid is jetted from the nozzle 6. Then, the multipurpose field 4 opens the motor damper 12 in response to the sensor signal sent through the nozzle 6 so that the pressure fluid sent from the nozzle blower 9 can effectively cause the multipurpose field 4 to float. As shown in FIG. 5, the motor damper 12 is opened in response to the sensor signal 80 detecting the existence of the multipurpose field 4 so that the pressure fluid is jetted. Consequently, the multipurpose field 4 is caused to slightly float and is alternately moved between the regions A and B by delivery means which will be described below. While pressure air is used as the fluid in the present example, a liquid (water) can also be used. Therefore, the pressure fluid to be used is not restricted to that of the present example.

With reference to FIGS. 6 to 10, examples of a structure of the multipurpose field 4 will be described below.

Figure 6:
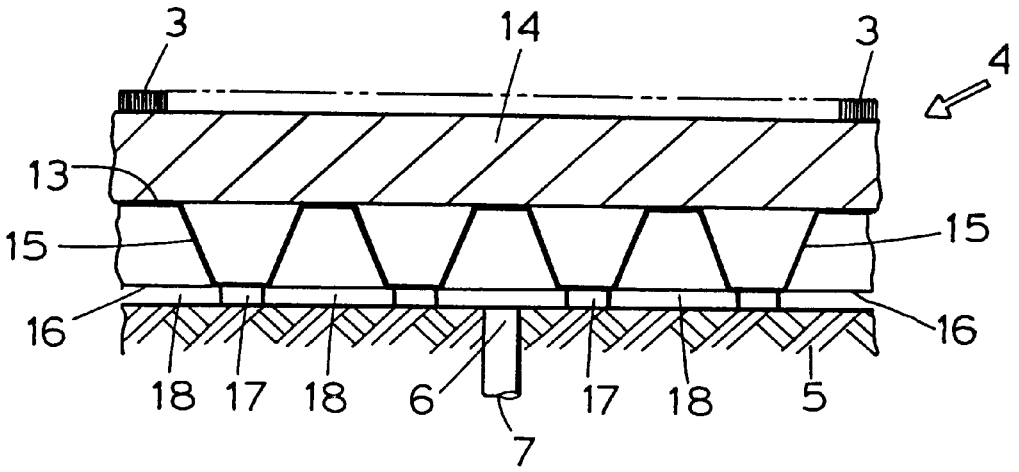
FIG. 6 is an enlarged sectional view showing a main part of a relationship between the multipurpose field and the nozzle.

As shown in FIG. 6, the multipurpose field 4 has the following structure. More specifically, an earth 14 is filled in a field base body 13 having a flat tray structure which has a long side of 120 m and a short side of 80 m and has a rectangular plane shape, for example, an iron plate. The natural lawn 3 is planted on a surface of the earth 14. A reinforcement body 15 having a corrugated sheet structure is provided over a whole back face of the field base body 13. In addition, a bottom plate 16 is provided on a whole lower face of the reinforcement body 15. Flat bars 17 are provided at regular intervals in contact with the basic floor plate 5 over a whole back face of the bottom plate 16. Thus, a pressure receiving zone 18 is provided to cause a pressure of the fluid jetted between the flat bars 17 to effectively operate.

Figure 7:
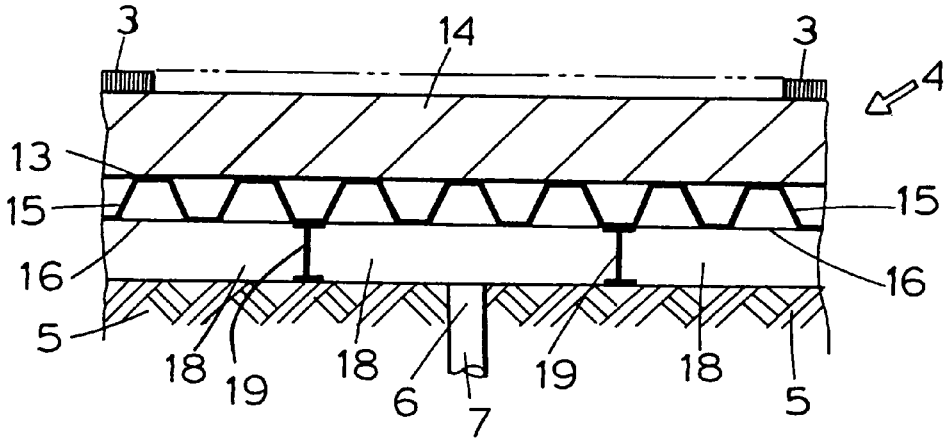
FIG. 7 is an enlarged sectional view showing a main part of another example of the relationship between the multipurpose field and the nozzle.

As shown in FIG. 7, a beam member 19 such as an H-shaped steel is provided in place of the flat bar 17. The multipurpose field 4 is formed by the field base body 13, the earth 14 having the natural lawn 3 planted, the reinforcement body 15, the bottom plate 16, and the flat bar 17 or the beam member 19 forming the pressure receiving zone 18. Since the multipurpose field 4 according to the present invention is used for purposes other than soccer and rugby games, it is not restricted to the present examples shown in the drawings.

Figure 8:
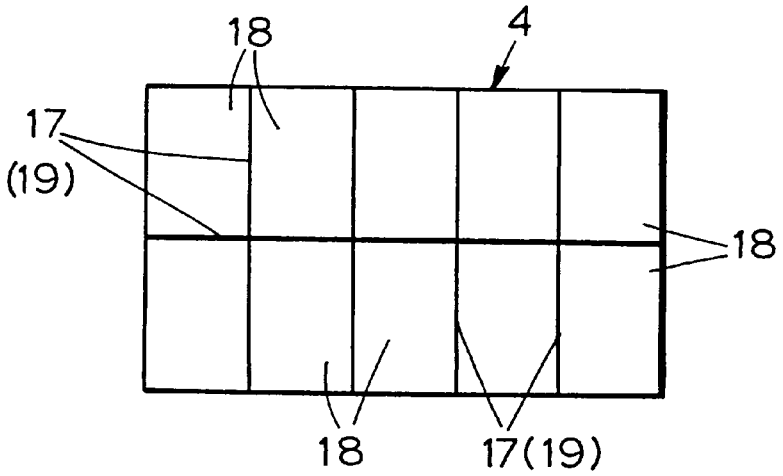
FIG. 8 is a rear view showing an example of arrangement of a flat bar or a beam on a lower face of the multipurpose field in FIG. 7.
Figure 19:
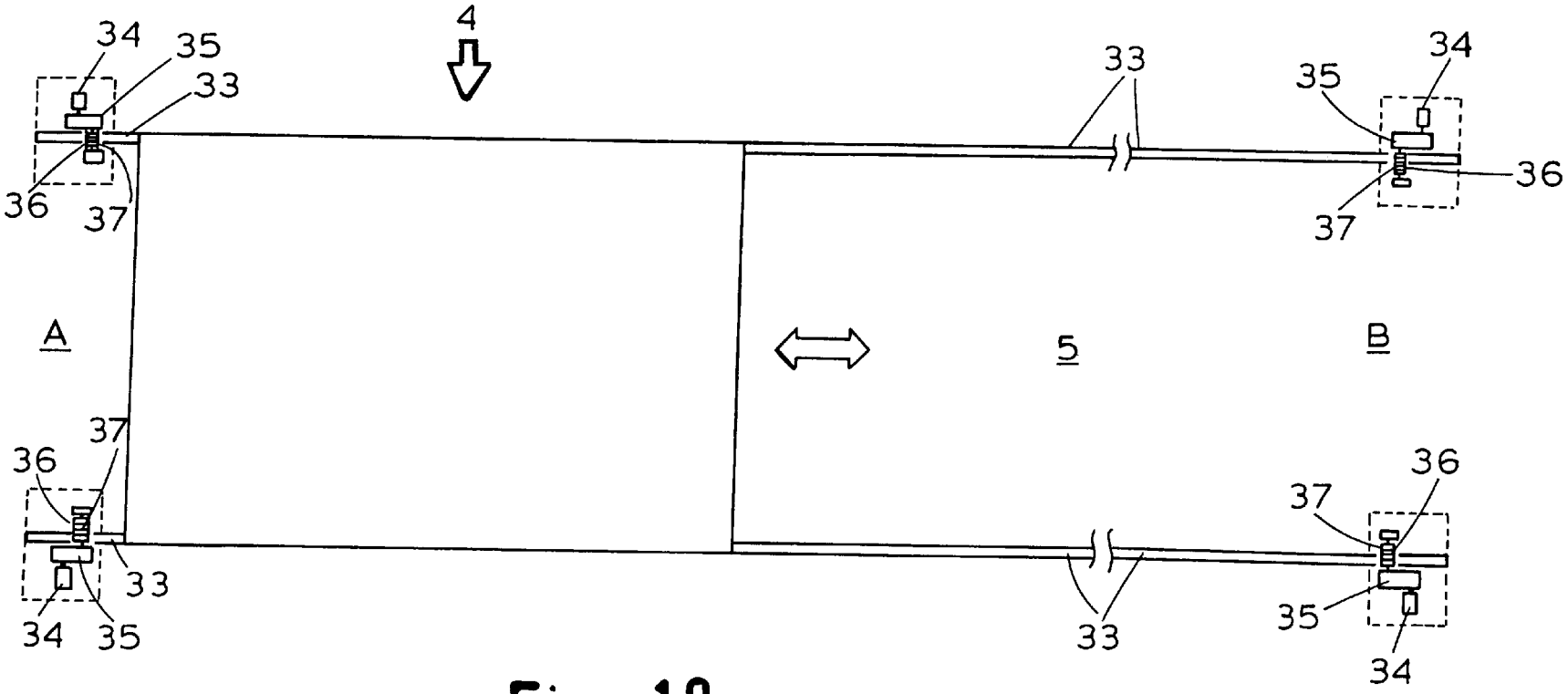
FIG. 19 is a plan view showing the delivery means of the multipurpose field using a wire.
Figure 20:
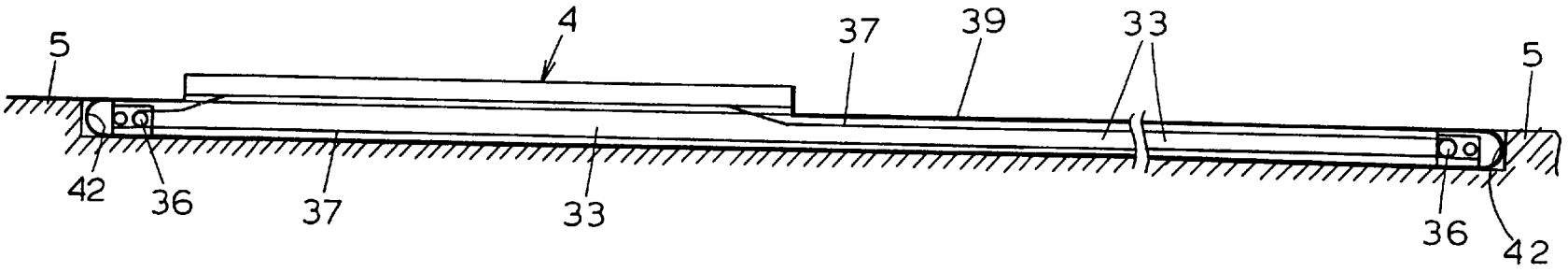
FIG. 20 is a longitudinal side view of FIG. 19.
Figure 23:
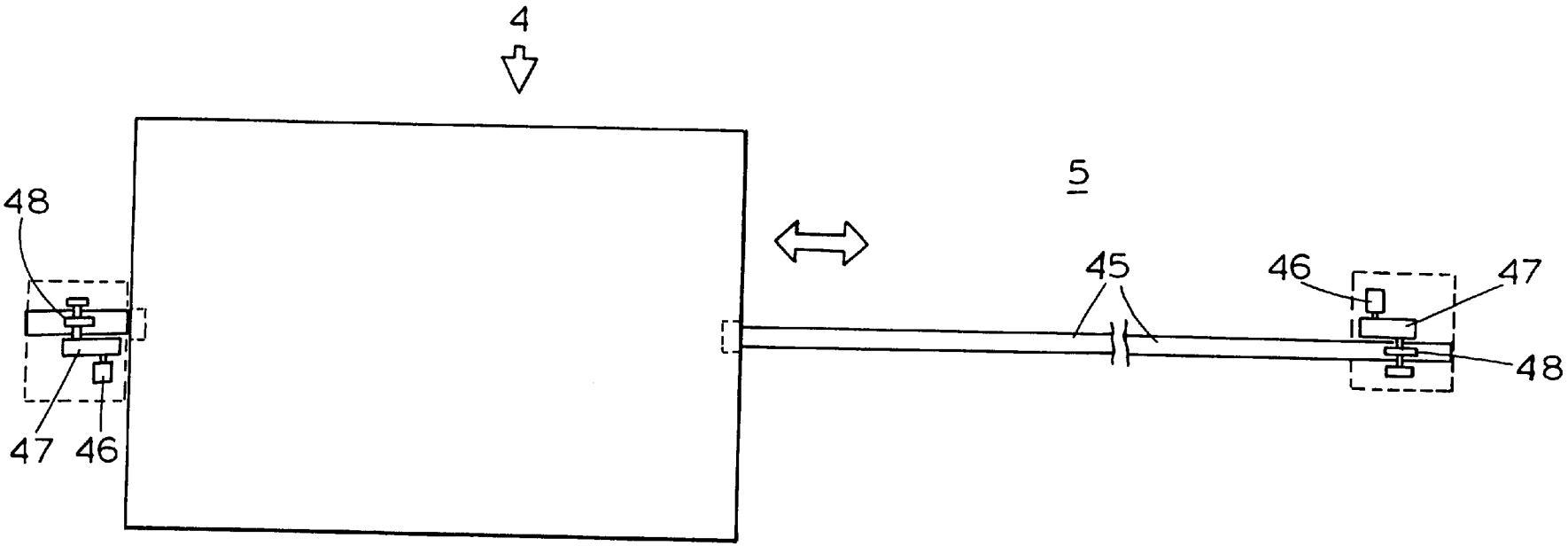
FIG. 23 is a plan view showing the delivery means of the multipurpose field using a chain.
Figure 24:
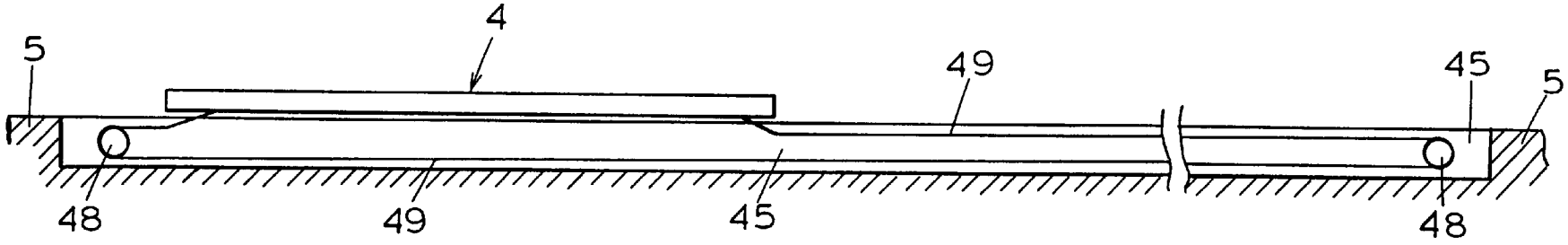
FIG. 24 is a longitudinal side view of FIG. 23.

FIGS. 8 to 10 show examples of the pressure receiving zone 18 formed by the flat bar 17 or the beam member 19. The flat bars 17 or the beam members 19 are provided longitudinally and transversely on a bottom face of the multipurpose field 4 to make a lattice structure so that a lot of square pressure receiving zones 18 are formed as shown in FIGS. 8 and 9, or the flat bars 17 or the beam members 19 which have a circular structure are provided in contact with each other on the bottom face of the multipurpose field 4 so that circular, triangular or diamond pressure receiving zones 18 are formed as shown in FIG. 10. The pressure receiving zone 18 is not restricted to the present examples but can optionally take other shapes. In addition, it is desirable that a skirt member (not shown) made of rubber or synthetic resin materials should be provided on an overall length of periphery of the multipurpose field 4 to prevent a loss of the jetted pressure fluid.

Means for blocking a jet hole 20 formed on a surface of the basic floor plate 5 to induce the upward pressure fluid jetted from the nozzle 6 will be described below with reference to FIGS. 11 to 16 (*a*) and 16 (*b*).

In an example shown in FIG. 11, the conical jet hole 20 is formed on the surface of the basic floor plate 5, and a nozzle 6 having a flat ring structure and having the pipe 7 for the pressure fluid connected to one side thereof is provided on the periphery of the jet hole 20. The jet hole 20 is provided with a valve 21 which is on a level with an upper face of the basic floor plate 5 in an upward attitude and which has a conical structure for blocking the nozzle 6 having the flat ring structure so as to rise and fall. A rod 22 is suspended from a center of a lower face of the valve 21 and is guided by a basic floor plate 5 portion. In addition, a spiral spring 23 for always energizing the valve 21 upward is resiliently provided between a guide portion formed in the basic floor plate 5 portion and the lower face of the valve 21. An up-down operator 24 is provided on one of sides of the basic floor plate 5. One of the ends of a wire 25 is coupled to a lower end of the up-down operator 24. The other end of the wire 25 is coupled to a lower end of the rod 22 of the valve 21 through a sheave 26.

The up-down operator 24 is pushed in a direction shown by an arrow, that is, downward in response to the signal from the sensor 80 detecting the existence of the multipurpose field 4. Consequently, the wire 25 is pulled with the valve 21 of the same line shown by a virtual line. Thus, the nozzle 6 is opened. In response to the signal passing through the nozzle 6, the up-down operator 24 is recovered and the valve 21 is caused to rise by resilient force of the spiral spring 23 so that the nozzle 6 is blocked and the jet hole 20 is not exposed to an upper face of the basic floor plate 5. The nozzle 6 can be blocked by an electromagnetic valve in addition to means shown in FIG. 11. Therefore, the blocking means is not restricted to the example shown in the drawing.

FIGS. 12 to 14 (*a*) and 14 (*b*) show examples in which the jet hole 20 has a rectangular plane shape. A side of a blocking plate 27 having almost the same shape and size as that of the jet hole 20 is pivotally supported in a portion close to an angular side of the basic floor plate 5 in an upper portion of the inside of the jet hole 20. The blocking plate 27 is positioned vertically in response to the signal detecting the existence of the multipurpose field 4 so that the jet hole 20 is opened. Consequently, the multipurpose field 4 is positioned horizontally in response to the signal passing through the nozzle 6 so that the jet hole 20 is blocked and is not exposed to the upper face of the basic floor plate 5.

In FIG. 13, two rotary shafts 28 are suspended from a center of the jet hole 20. Each rotary shaft 28 is provided with a blocking plate 29 having almost the half area of that of the jet hole 20. The blocking plate 29 is positioned vertically shown by a virtual line in response to the signal detecting the existence of the multipurpose field 4 so that the jet hole 20 is opened. In addition, the multipurpose field 4 is positioned horizontally in response to the signal passing through the nozzle 6 so that the jet hole 20 is blocked and is not exposed to the upper face of the basic floor plate 5. FIGS. 14 (*a*) and 14 (*b*) show plane shapes of the jet hole 20 which can be employed by the example shown in FIG. 13.

FIG. 15 shows an example of the upper face of the jet hole 20 having a grating 30 on a level with the upper face of the basic floor plate 5. Since the jet hole 20 is not completely blocked, this example is suitable for the field region A of the roofed stadium 1. FIGS. 16 (*a*) and 16 (*b*) show plane shapes of the jet hole 20 which can be employed by the example shown in FIG. 15.

With reference to FIGS. 17 to 34, delivery means will be described below. In the present examples, the multipurpose field 4 is alternately moved in a direction of the arrow "a" between the field region A of the roofed stadium 1 and the outdoor region B, is moved in the field region A, or is moved in directions of the arrows "b", "c" and "d" in the outdoor region B.

FIGS. 17 and 18 show the delivery means for moving the multipurpose field 4 only by operation of the pressure fluid jetted from the nozzle 6.

In an example of FIG. 17, upper ends of fluid resistance plates 31 whose angles can be regulated are pivotally attached to both sides of the beam member 19 forming the multipurpose field 4, that is, both sides of a lower face of a bottom plate 16 corresponding to the pressure receiving zone 18. The fluid resistance plates 31 are rotated simultaneously in a direction reverse to that of delivery of the multipurpose field 4 by operation of a control board (which is not shown), and their angles are regulated such that a fluid pressure intensively acts on one of the fluid resistance plates 31 sharply opposed to a flow of the pressure fluid.

In the present example, when the fluid resistance plate 31 is in a rotating position shown by a solid line, the multipurpose field 4 is caused to float by the pressure of the fluid jetted from the nozzle 6, and the fluid pressure strongly acts on one of the fluid resistance plates 31 in the pressure receiving zone 18 and the fluid flows without resistance to the other fluid resistance plate 31. Consequently, the multipurpose field 4 can continuously be moved in a direction of an arrow, and can be delivered and provided in predetermined positions of the regions A and B. In case of delivery in the reverse direction, it is sufficient that the fluid resistance plate 31 is rotated in a position shown by a virtual line. By selecting "large" or "small" of rotating angle regulation of the fluid resistance plate 31, a moving speed of the multipurpose field 4 can optionally be regulated.

In an example of FIG. 18, the lower end(s) of one or more deflection plates 32 for the pressure fluid is/are pivotally supported on an upper open end of the jet hole 20 such that it/they can be deflected. The deflection plates 32 are rotated simultaneously in the direction of the delivery of the multipurpose field 4 by the operation of the control board (not shown) in the above-mentioned manner. Consequently, a high pressure resistance of the fluid is caused to act on a side of one of the beam members 19 forming the pressure receiving zones 18 so that the multipurpose field 4 is continuously moved in a direction shown by an arrow. Thus, the multipurpose field 4 can be delivered and provided in predetermined positions of the regions A and B. In case of delivery in the reverse direction, it is sufficient that the deflection plate 32 is deflected in a direction reverse to that of the drawing. By regulating the angle of the deflection plate 32, the moving speed of the multipurpose field 4 can optionally be adjusted.

With reference to FIGS. 19 to 22, means for delivering the multipurpose field 4 using a wire will be described below.

One or more thin pits 33 is/are provided on the basic floor plate 5 from the vicinity of a main stand of the field region A of the roofed stadium 1 to the vicinity of an outermost end of the outdoor region B shown in FIGS. 1 and 2. A distance between the pits 33 formed on both sides of the basic floor plate 5 is almost equal to that of a short side of the multipurpose field 4. A winch drum 36 is provided on both ends of each pit 33. The winch drum 36 is rotated and driven through a motor 34 and a reduction gear 35. Both ends of a wire 37 having a middle portion wrapped around the winch drum 36 are coupled to both ends of short sides of the multipurpose field 4 or a middle portion thereof.

As shown in FIG. 21, the middle portion of the wire 37 stretched on the opposed winch drums 36 is supported and guided by a support sheave 38 for preventing slack which is provided below the middle portion of the pit 33. As shown in FIGS. 21 and 22, one of ends of a long pit cover 39 having an articulated structure, that is, a caterpillar structure is coupled just above the wire 37 connected to both ends on the short sides of the multipurpose field 4. A guide roller 40 having a small diameter which is pivotally supported on both sides of an articulated portion of the pit cover 39 is slid on a horizontal guide rail 41 provided on both upper ends of an opening of the pit 33 and a circular guide rail 42 provided on both ends of the pit 33 as shown in FIGS. 21 and 22. In addition, an outer free end of the pit cover 39 is slid on a bottom of the pit 33. In FIG. 21, the reference numeral 43 denotes a space in which the pit cover 39 passes through an underside of the support sheave 38, and the reference numeral 44 denotes a guide roller for preventing rolling of the multipurpose field 4.

According to the delivery means having such a structure, for example, the wire 37 is wrapped around the winch drum 36 provided on a field region A side so that the multipurpose field 4 in the outdoor region B can be pulled into the roofed stadium 1. Conversely, the wire 37 is wrapped around the winch drum 36 on an outdoor region B side so that the multipurpose filed 4 in the roofed stadium 1 is moved and provided in the outdoor region B. In this case, the pits 33 other than those concealed by the multipurpose field 4 formed on the basic floor plate 5 are blocked on a level with the surface of the basic floor plate 5 by the pit cover 39.

With reference to FIGS. 23 to 27, a structure of the delivery means of the multipurpose field 4 using a chain will be described below.

A single (or plurality of) thin pit(s) 45 is/are formed on the basic floor plate 5 from the vicinity of the main stand of the field region A of the roofed stadium 1 to the vicinity of an outermost end of the outdoor region B shown in FIGS. 1 and 2, and a mechanism for transmitting power of a motor 46 to a sprocket 48 through a reduction gear 47 is provided on both ends of the pit 45. A long chain 49 is wrapped around the sprocket 48 provided on the both ends of the pit 45. Both ends of the long chain 49 are coupled to a central portion on a short side of the multipurpose field 4 (or the other short side).

Figure 25:
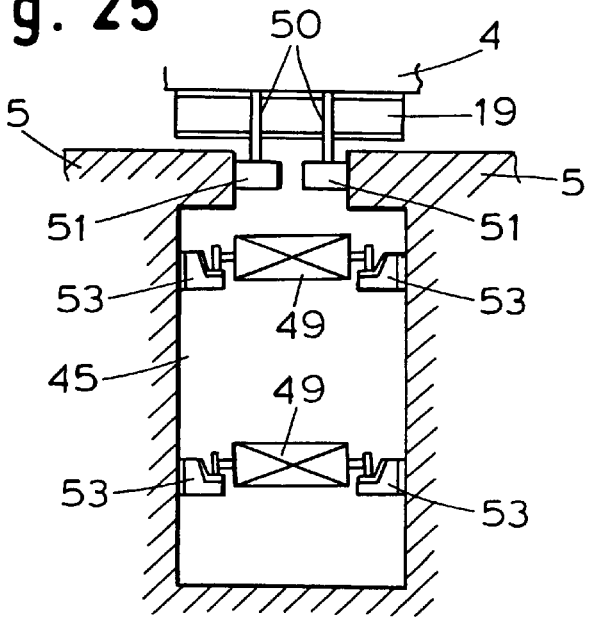
FIG. 25 is a longitudinal front view showing a main part of a rolling prevention mechanism in FIG. 24.
Figure 26:
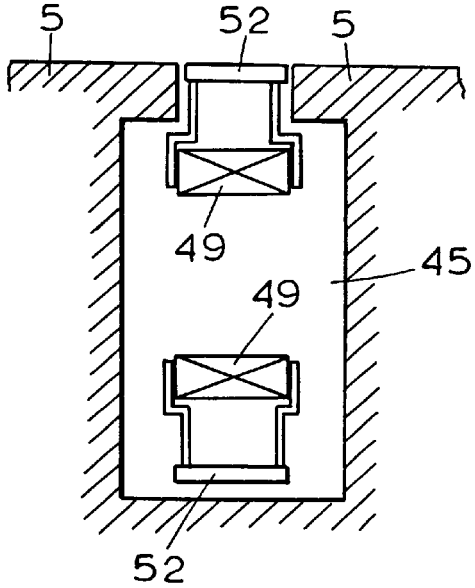
FIG. 26 is a longitudinal front view showing a pit cover in FIG. 24.
Figure 27:
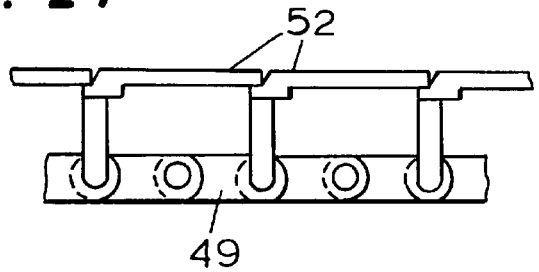
FIG. 27 is a side view showing the pit cover in FIG. 26.

As shown in FIG. 25, guide rollers 51 for preventing rolling are provided on lower ends of shafts 50 suspended from a lower face of the multipurpose field 4 at regular intervals. The guide rollers 51 come in contact with both sides of an upper end of the pit 45 and rotate. As shown in FIGS. 26 and 27, a pit cover forming piece 52 is continuously provided over an outside of the chain 49. The pits 45 other than those concealed by the multipurpose field 4 are blocked on a level with an upper face of the basic floor plate 5 by the continuous pit cover forming piece 52. The reference numeral 53 denotes a chain guide provided on each side wall of the pit 45.

According to the delivery means having such a structure, for example, the sprocket 48 provided on the field region A side is driven to pull the chain 49 so that the multipurpose field 4 in the outdoor region B is pulled into the field region A of the roofed stadium 1. Conversely, the sprocket 48 provided on the outdoor region B side is driven to pull in the chain 49 so that the multipurpose field 4 in the roofed stadium 1 is moved and provided in the outdoor region B. In this case, the pits 45 other than those concealed by the multipurpose field 4 formed on the basic floor plate 5 are blocked on a level with the surface of the basic floor plate 5 by the pit cover forming pieces 52 which are continuously provided.

Figure 28:
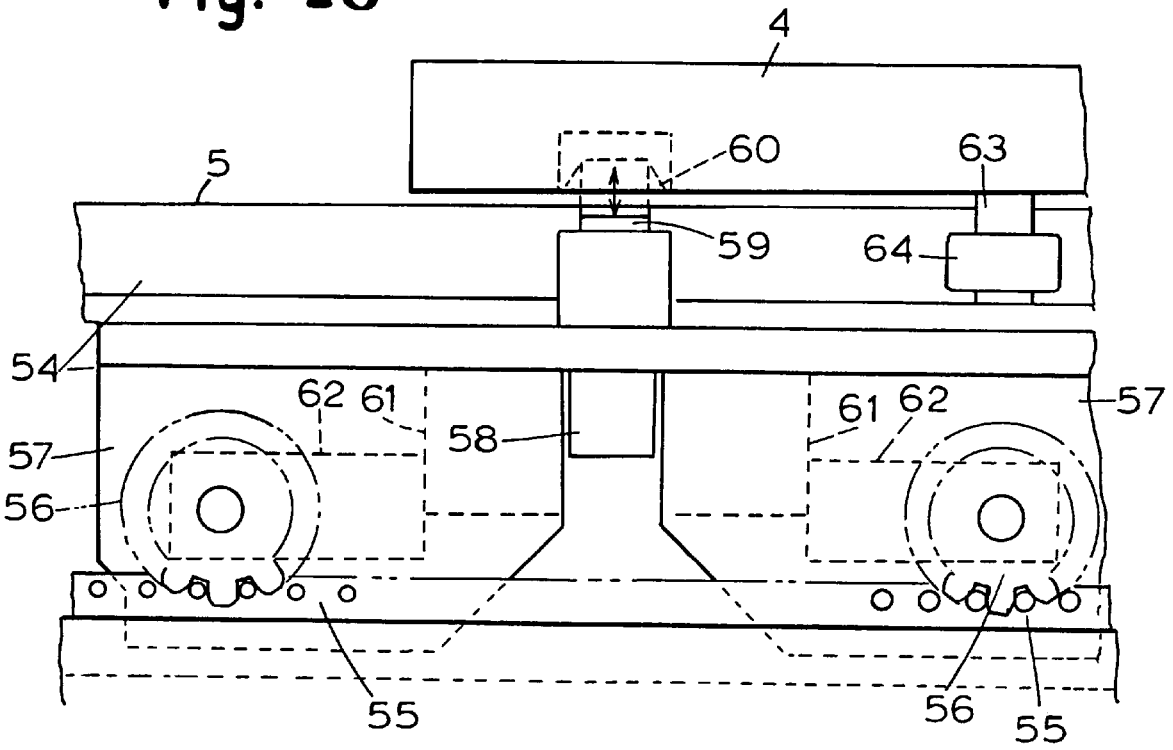
FIG. 28 is a side view showing a main part of an example of the delivery means of the multipurpose field.
Figure 29:
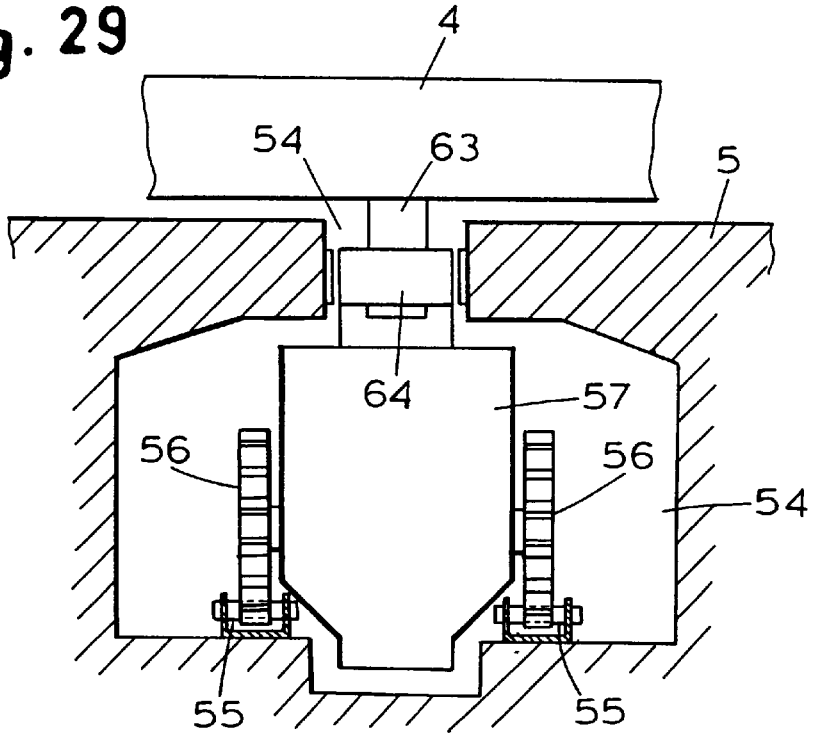
FIG. 29 is a longitudinal front view of FIG. 28.
Figure 30:
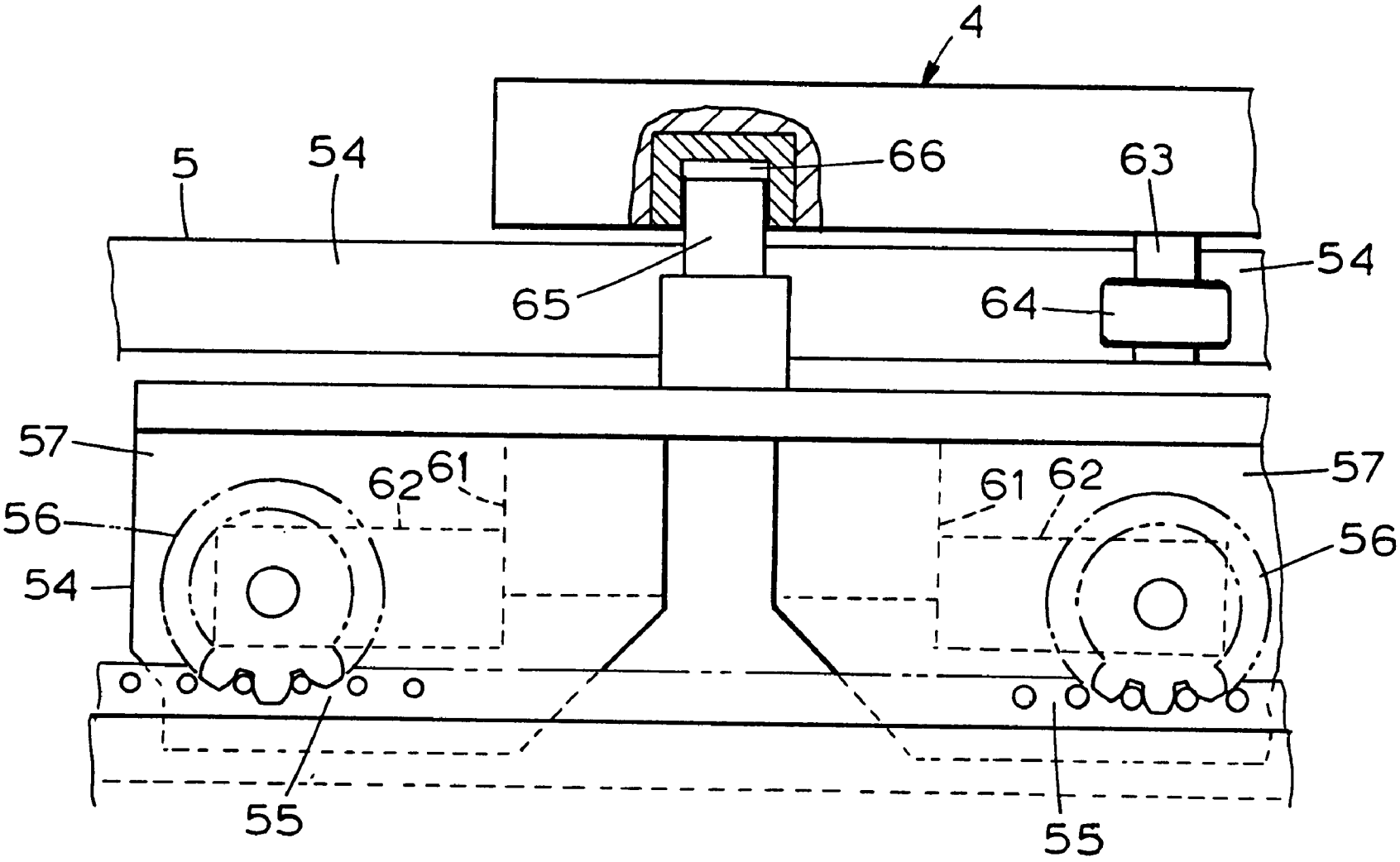
FIG. 30 is a side view showing a main part of another example of FIG. 28 with a part thereof cut away.

FIGS. 28 to 30 show delivery means for moving the multipurpose field 4 with a rack—pinion structure.

A single (or plurality of) pit(s) 54 is/are formed on the basic floor plate 5 from the vicinity of the main stand of the field region A of the roofed stadium 1 to the vicinity of the outermost end of the outdoor region B shown in FIGS. 1 and 2. Two parallel rack forming bodies 55 are provided over a bottom portion of the pit 54, and a mobile truck 57 having a pinion 56 provided on each longitudinal side is mounted on the rack forming body 55. The pinion 56 is engaged with the rack forming body 55. At least two mobile trucks 57 are provided on longitudinal ends of the multipurpose field 4.

As shown in FIGS. 28 and 29, an engagement pin 59 is suspended from a central portion of the mobile truck 57. The engagement pin 59 vertically expands and contracts by a cylinder 58 and protrudes from the upper face of the basic floor plate 5 so as to be engaged with an engage concave section 60 formed on a lower face of the longitudinal end of the floating multipurpose field 4. Furthermore, two motors 61 are mounted on the mobile truck 57. Driving force of each motor 61 is transmitted to the pinion 56 through a reduction gear mechanism 62 so that the mobile truck 57 is moved in a direction of the arrow "a" in FIG. 1. The reference numeral 63 denotes a plurality of shafts suspended from the lower face of the multipurpose field 4. A guide roller 64 is pivotally mounted freely to a lower end of the shaft 63. The guide roller 64 is guided along both side walls of an upper end of the pit 54 and serves to prevent rolling of the multipurpose field 4.

According to the delivery means, the engagement pin 59 is raised following the engagement concave section 60 of the multipurpose field 4 which floats under a fluid pressure or the engagement pin 59 is raised and engaged with the engagement concave section 60 of the floating multipurpose field 4. Then, the motor 61 is driven to rotate the pinion 56 and to cause the mobile truck 57 to run on the rack forming body 55. Thus, the multipurpose field 4 can be moved in the direction of the arrow "a" shown in FIG. 1 and can be provided in a predetermined position.

In an example shown in FIG. 30, an engagement pin 65 is provided in a central portion of the mobile truck 57. The engagement pin 65 is formed to always protrude from the upper portion of the basic floor plate 5. The engagement pin 65 is always engaged with an engagement concave section 66 formed on the multipurpose field 4. An amount of protrusion of the engagement pin 65 is such as to keep an engagement relationship with the engagement concave section 66 even if the multipurpose field 4 floats. Since the function of the delivery means shown in FIG. 30 is identical to that of FIGS. 28 and 29, its detailed description will be omitted.

A rack forming body is provided on the lower face of the multipurpose field 4 and an up-down pinion is provided on the upper face of the mobile truck 57 mounted on the basic floor plate 5 side so that the multipurpose field 4 can be moved, which are not shown. Therefore, the delivery means shown in the present example is not restricted to the drawing.

With reference to FIGS. 31 to 34, a structure of delivery means for moving the multipurpose field 4 like a looper will be described below.

Figure 31:
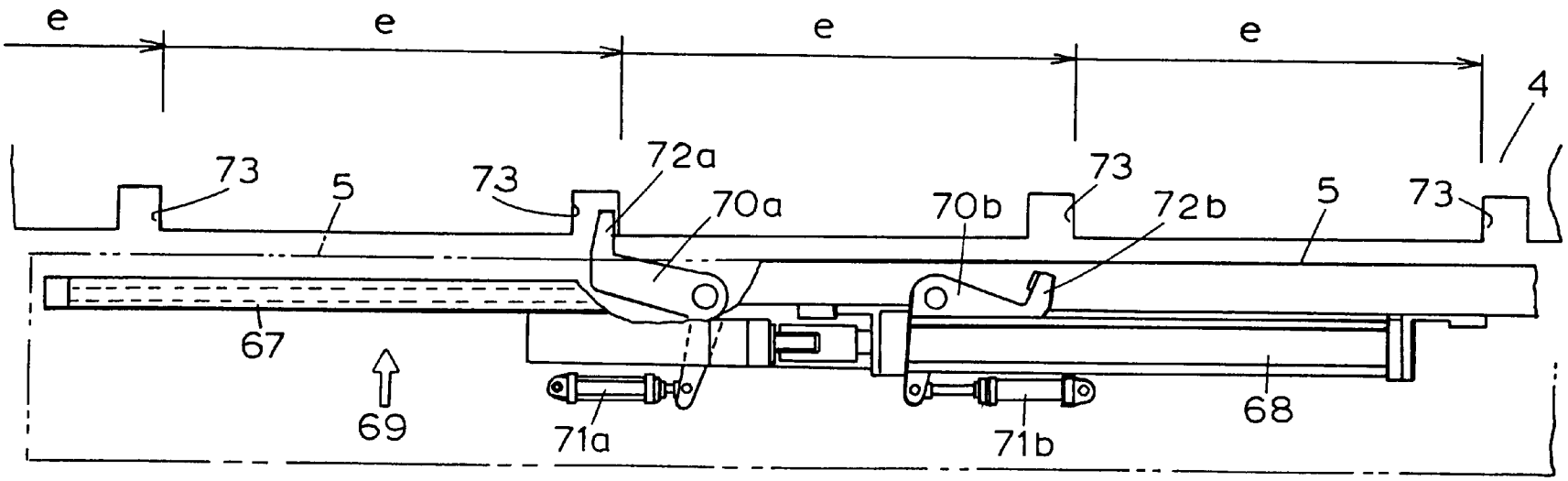
FIG. 31 is a side view showing an example of the delivery means of the multipurpose field.
Figure 32:
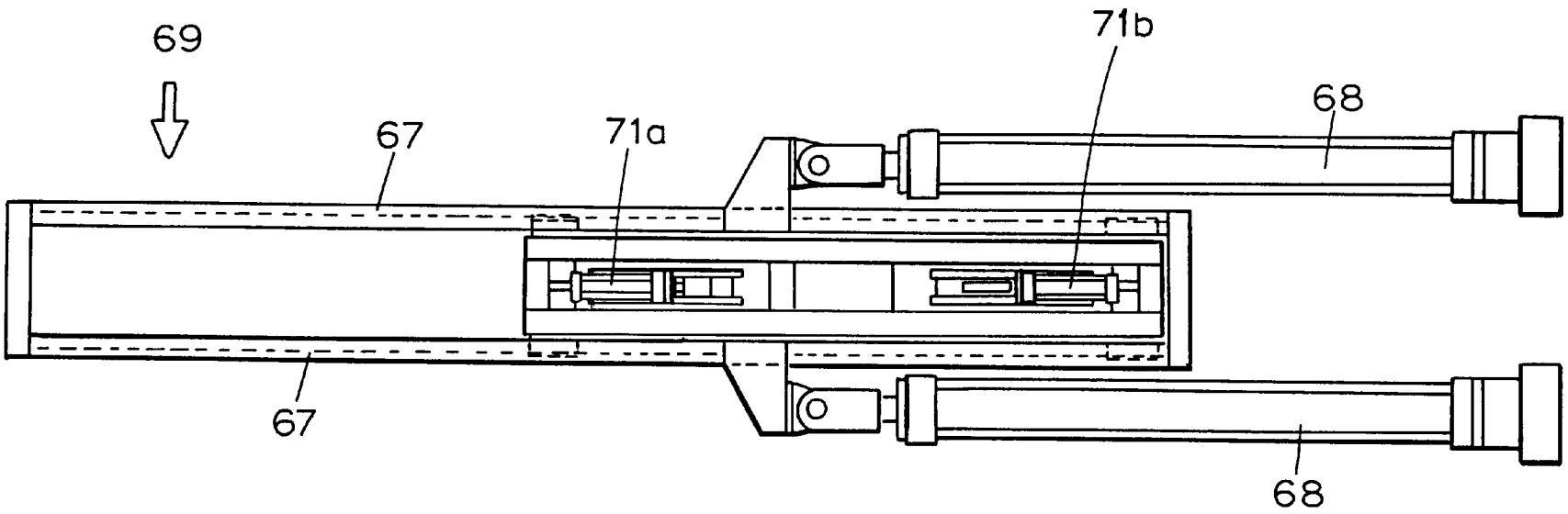
FIG. 32 is a plan view of FIG. 31.
Figure 33:
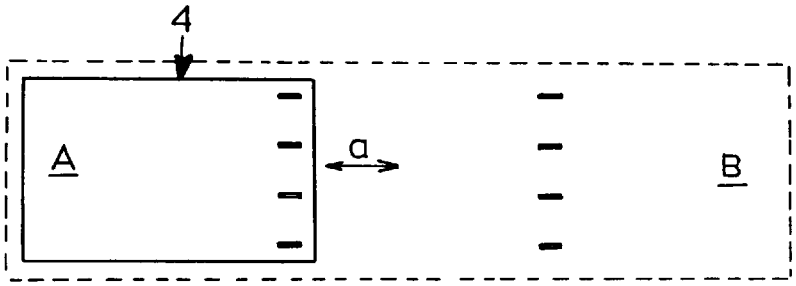
FIG. 33 is a plan view showing arrangement of FIG. 31.
Figure 34:
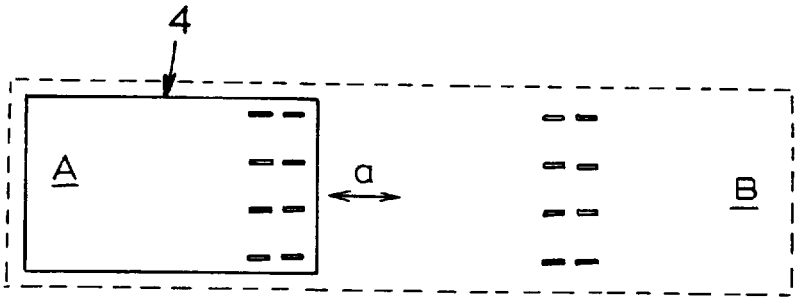
FIG. 34 is a plan view showing the arrangement of FIG. 31.

As shown by "-" in FIGS. 33 and 34, the delivery means shown in FIGS. 31 and 32 is provided parallel with the upper face of the basic floor plate 5 in a rear portion of the field region A of the roofed stadium 1 and a front portion on a roofed stadium 1 side of the outdoor region B. The delivery means has the following structure.

The reference numeral 67 denotes two parallel guide rails which are comparatively long and have both ends connected to each other at regular intervals. The guide rails 67 are provided parallel with a direction of movement of the multipurpose field 4. An operation member 69 is slidably provided between the guide rails 67. The operation member 69 reciprocates by a stroke length determined by two cylinders 68 provided on both sides. Middle portions of operation levers 70*a* and 70*b* having inverted L-shaped sides are pivotally attached to the back of the operation member 69, and small cylinders 71*a* and 71*b* are provided between lower ends of the operation levers 70*a* and 70*b* and the operation member 69. The cylinders 71*a* and 71*b* rotate the operation levers 70*a* and 70*b* opposite to each other. Upward engagement clicks 72*a* and 72*b* are formed opposite to each other on upper ends of the operation levers 70*a* and 70*b*, respectively. An engagement concave section 73 is provided over the back of the multipurpose field 4. Each of the engagement clicks 72*a* and 72*b* is fitted in and engaged with the engagement concave section 73. A longitudinal distance between the engagement concave sections 73 is equal to a stroke of the cylinder 68. The delivery means according to the present example has the above-mentioned structure. As shown in FIGS. 33 and 34, the delivery means is provided in a line or lines in a direction of the short side of the multipurpose field 4, that is, along an axis perpendicular to a direction of movement of the multipurpose field 4 shown by an arrow "a".

According to the delivery means having such a structure, when the cylinder 71*a* is caused to expand in the state shown in FIG. 31, the operation lever 70*a* is rotated counterclockwise so that the engagement click 72*a* is disengaged from the engagement concave section 73 of the multipurpose field 4. When the cylinder 68 is caused to expand in this state, the operation member 69 pivotally supporting the operation levers 72*a* and 72*b* is moved by a constant stroke in a left direction along the guide rail 67. When the cylinder 71*a* contracts, the operation lever 70*a* is rotated clockwise so that the engagement click 72*a* on a tip end is fitted in and engaged with the engagement concave section 73. When operation is performed such that the cylinder 68 is caused to contract in the same state, the multipurpose field 4 is moved by a working stroke length of the cylinder 68 in a right direction shown by an arrow "e". This delivery operation is intermittently repeated so that the multipurpose field 4 can be delivered like a looper and can be moved and provided in a predetermined position.

For some reasons, the multipurpose field 4 does not float uniformly but floats with deviation or is inclined during delivery so that the multipurpose field 4 may be moved with one of sides thereof in contact with the basic floor plate 5. Consequently, the multipurpose field 4 and/or the basic floor plate 5 may be damaged. It is necessary to compensate for the unexpected damage.

Figure 35:
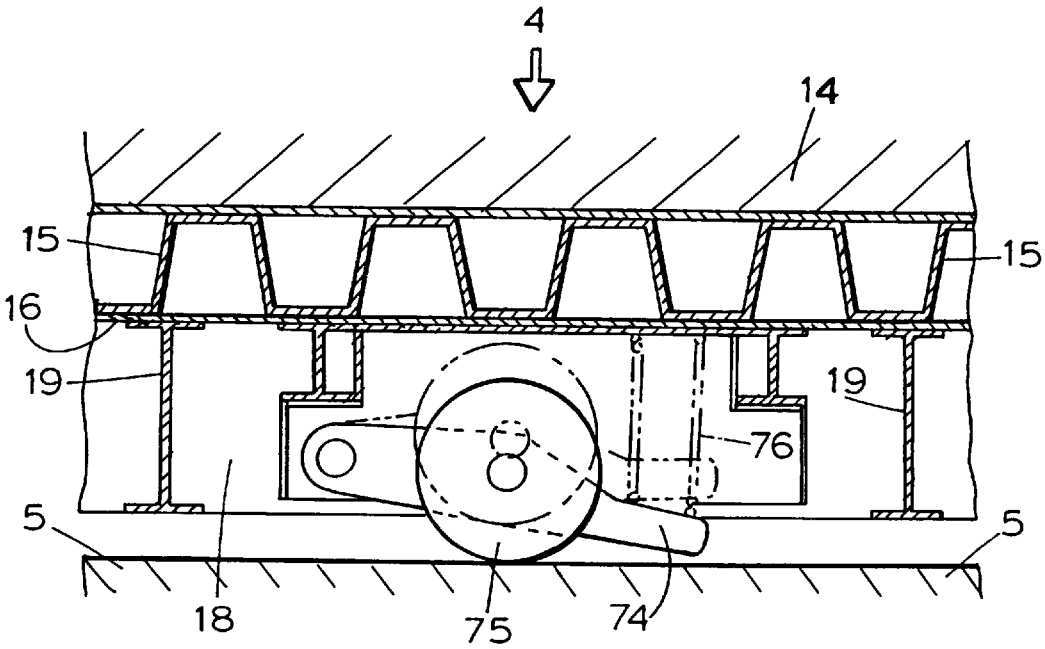
FIG. 35 is a side view showing back-up means provided on the lower face of the multipurpose field.

Back-up means shown in FIG. 35 is used for such a purpose. One of ends of a lever 74 in the delivery direction "a" is pivotally supported on a lower face of a bottom plate 16 corresponding to each pressure receiving zone 18 formed around the multipurpose field 4. A wheel 75 is pivotally fixed to a middle portion of the lever 74, and a spiral spring 76 is resiliently provided between an upper face of a free end of the lever 74 and the lower face of the bottom plate 16 such that the wheel 75 always comes in contact with a surface of the basic floor plate 5.

The spiral spring 76 is not restricted to that shown in the drawing because an oil hydraulic or air cylinder can be used in place of the spiral spring 76.

According to the back-up means, when the multipurpose field 4 floats, the wheel 75 falls by the operation of the spiral spring 76. Therefore, the multipurpose field 4 can smoothly be delivered. In addition, when the multipurpose field 4 floats with deviation or is inclined during delivery, all the spiral springs 76 effectively function so that the multipurpose field 4 can be inhibited from coming in contact with the basic floor plate 5 as much as possible. Thus, their damages can be prevented.

According to the structures of the present invention described above, the following effects can be obtained.

Since the multipurpose field is caused to float above the basic floor plate in the state of non-contact, the delivery means of the multipurpose field can effectively become small-sized and simplified. In addition, alternate movement between the field region of the roofed stadium and the outdoor region and movement in the field region or the outdoor region can be performed rapidly. For example, a diamond for baseball games can be converted into a field for soccer in a short time.

Although the present invention has fully been described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A method for moving a multipurpose field between a field region of a roofed stadium and an outdoor region, comprising the steps of:

providing (1) a floor plate beneath the movable multipurpose field and extending from the field region of the roofed stadium and the outdoor region, (2) a sensor for sensing the presence of the movable multipurpose field above the floor plate, (3) a plurality of jet nozzles between the floor plate and the movable multipurpose field, and (4) delivery means for moving the multipurpose field between the field region of the roofed stadium and the outdoor region;

sensing the presence of the movable multipurpose field above the floor plate;

supplying fluid pressure to the jet nozzles in response to the sensed presence of the movable multipurpose field and causing the multipurpose field to float under a pressure of the fluid jetted upward from the jet nozzles; and moving and placing the multipurpose field by the delivery means.

2. A method for moving a multipurpose field in a field region of a roofed stadium, comprising the steps of:

providing (1) a floor plate beneath the movable multipurpose field and extending within the roofed stadium, (2) a sensor for sensing the presence of the movable multipurpose field above the floor plate, (3) a plurality of jet nozzles between the floor plate and the movable multipurpose field, and (4) delivery means for moving the multipurpose field in the field region of the roofed stadium;

sensing the presence of the movable multipurpose field above the floor plate;

supplying fluid pressure to the jet nozzles in response to the sensed presence of the movable multipurpose field and causing the multipurpose field to float under a pressure of the fluid jetted upward from the jet nozzles; and moving and placing the multipurpose field by the delivery means.

3. A method for moving a multipurpose field in an outdoor region, comprising the steps of:

providing (1) a floor plate beneath the movable multipurpose field and extending within the outdoor region, (2) a sensor for sensing the presence of the movable multipurpose field above the floor plate, (3) a plurality of jet nozzles between the floor plate and the movable multipurpose field, and (4) delivery means for moving the multipurpose field within the outdoor region;

sensing the presence of the movable multipurpose field above the floor plate;

supplying fluid pressure to the jet nozzles in response to the sensed presence of the movable multipurpose field and causing the multipurpose field to float under a pressure of the fluid jetted upward from the jet nozzles; and moving and placing the multipurpose field by the delivery means.

4. Apparatus for moving a multipurpose field between a field region of a roofed stadium and an outdoor region, said apparatus comprising:

a floor plate beneath the movable multipurpose field and extending from the field region of the roofed stadium and the outdoor region;

a sensor for sensing the presence of the movable multipurpose field above the floor plate;

a plurality of jet nozzles between the floor plate and the movable multipurpose field;

fluid pressure supply means responding to the sensor sensing the presence of the movable multipurpose field above the floor plate for supplying fluid pressure to the jet nozzles for causing the multipurpose field to float under the pressure of the fluid jetted upward from the jet nozzles; and delivery means for alternately moving the multipurpose field between the field region of the roofed stadium and the outdoor region.

5. Apparatus for moving a multipurpose field within a field region of a roofed stadium, said apparatus comprising:

a floor plate beneath the movable multipurpose field and extending within the roofed stadium;

a sensor for sensing the presence of the movable multipurpose field above the floor plate;

a plurality of jet nozzles between the floor plate and the movable multipurpose field;

fluid pressure supply means responding to the sensor sensing the presence of the movable multipurpose field above the floor plate for supplying fluid pressure to the jet nozzles for causing the multipurpose field to float under the pressure of the fluid jetted upward from the jet nozzles; and delivery means for moving the multipurpose field in the field region of the roofed stadium.

6. Apparatus for moving a multipurpose field within an outdoor region, said apparatus comprising:

a floor plate beneath the movable multipurpose field and extending within the outdoor region;

a sensor for sensing the presence of the movable multipurpose field above the floor plate;

a plurality of jet nozzles between the floor plate and the movable multipurpose field;

fluid pressure supply means responding to the sensor sensing the presence of the movable multipurpose field above the floor plate for supplying fluid pressure to the jet nozzles for causing the multipurpose field to float under the pressure of the fluid jetted upward from the jet nozzles; and delivery means for moving the multipurpose field in the outdoor region.

7. The apparatus for moving a multipurpose field according to any of claims 4 to 6, wherein the delivery means is provided on the floor plate.

8. The apparatus for moving a multipurpose field according to any of claims 4 to 6, including means for applying the fluid pressure jetted from each of the plurality of jet nozzles in a direction of movement of the multipurpose field.

* * * * *